US007311142B2

(12) United States Patent
Fisseler et al.

(10) Patent No.: US 7,311,142 B2
(45) **Date of Patent: *Dec. 25, 2007**

(54) APPARATUS AND METHOD FOR AQUIRING INFORMATION WHILE DRILLING

(75) Inventors: Patrick Fisseler, Missouri City, TX (US); Tom Palmer, Stafford, TX (US); James Mather, Richmond, TX (US); Colin Longfield, Houston, TX (US); Richard Meehan, Sugar Land, TX (US); Jean-Marc Follini, Houston, TX (US); Jean-Michel Hache, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/469,555

(22) Filed: Sep. 1, 2006

(65) Prior Publication Data

US 2007/0039730 A1 Feb. 22, 2007

Related U.S. Application Data

(63) Continuation of application No. 10/707,152, filed on Nov. 24, 2004, now Pat. No. 7,114,562.

(51) Int. Cl.
*E21B 47/00* (2006.01)

(52) U.S. Cl. ..... 166/250.02; 166/250.07; 166/100

(58) Field of Classification Search ..... 166/250.02, 166/250.07, 100; 175/50
See application file for complete search history.

(56) References Cited

U.S. PATENT DOCUMENTS

| | | | | |
|---|---|---|---|---|
| 3,934,468 | A | 1/1976 | Brieger | |
| 4,860,581 | A | 8/1989 | Zimmerman et al. | |
| 4,893,505 | A | 1/1990 | Marsden et al. | |
| 4,936,139 | A | 6/1990 | Zimmerman et al. | |
| 5,622,223 | A | 4/1997 | Vasquez | |
| 6,026,915 | A | 2/2000 | Smith et al. | |
| 6,230,557 | B1 * | 5/2001 | Ciglenec et al. | 73/152.01 |
| 6,729,399 | B2 | 5/2004 | Pop et al. | |
| 6,986,282 | B2 * | 1/2006 | Ciglenec et al. | 73/152.51 |
| 7,114,562 | B2 * | 10/2006 | Fisseler et al. | 166/250.02 |
| 2002/0062992 | A1 | 5/2002 | Fredericks et al. | |

* cited by examiner

*Primary Examiner*—William P Neuder
(74) *Attorney, Agent, or Firm*—Matthias Abrell; Kevin P. McEnaney; Dale V. Gaudier

(57) ABSTRACT

A downhole tool positionable in a wellbore for penetrating a subterranean formation includes a housing having at least one protuberance extending therefrom. The protuberance has at least one centralizing section and a protective section. A probe is positioned in the protective section such that the horizontal cross-sectional area of the housing along the protective section is less than the horizontal cross-sectional area of the housing along the at least one centralizing section.

29 Claims, 8 Drawing Sheets

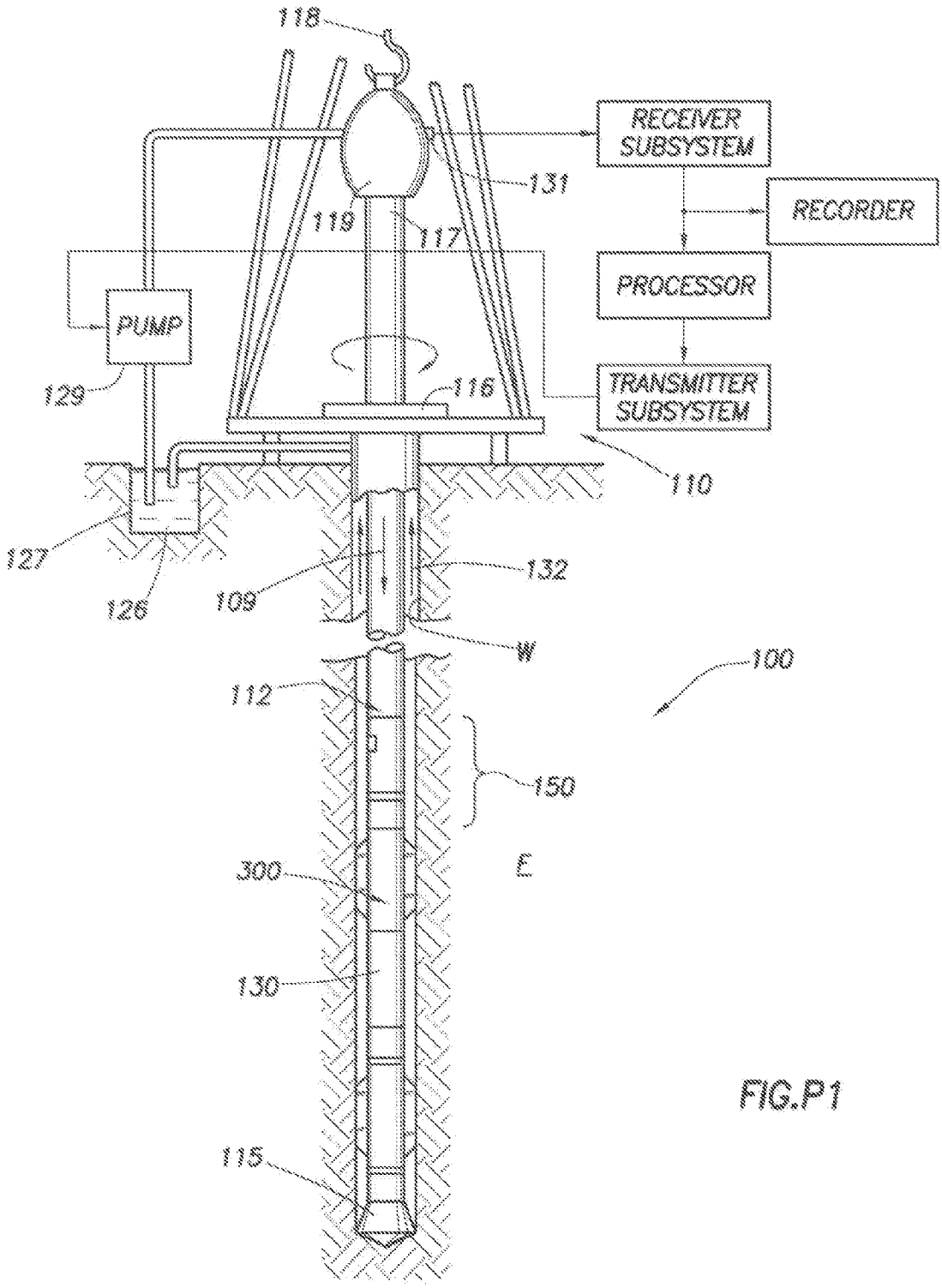
FIG.P1

A–A

APPARATUS AND METHOD FOR AQUIRING INFORMATION WHILE DRILLING

CROSS REFERENCE TO RELATED APPLICATION

This application is a continuation application of U.S. patent application Ser. No. 10/707,152, filed Nov. 24, 2004, now U.S. Pat. No. 7,114,562, the content of which is incorporated herein by reference for all purposes.

BACKGROUND OF THE INVENTION

1. Field of the Invention

The present invention relates to the acquisition of information, such as pore pressure, from a subsurface formation while drilling. More particularly, the present invention relates to the stabilization and retrieval of apparatuses having utility for acquiring such information.

2. Background of the Related Art

Present day oil well operation and production involves continuous monitoring of various subsurface formation parameters. One aspect of standard formation evaluation is concerned with the parameters of reservoir pressure and the permeability of the reservoir rock formation. Continuous monitoring of parameters such as reservoir pressure and permeability indicate the formation pressure change over a period of time, and is essential to predict the production capacity and lifetime of a subsurface formation. Present day operations typically obtain these parameters through wireline logging via a "formation tester" tool. This type of measurement requires a supplemental "trip", i.e., removing the drill string from the wellbore, running a formation tester into the wellbore to acquire the formation data and, after retrieving the formation tester, running the drill string back into the wellbore for further drilling. Thus, it is typical for formation parameters, including pressure, to be monitored with wireline formation testing tools, such as those tools described in U.S. Pat. Nos. 3,934,468; 4,860,581; 4,893,505; 4,936,139; and 5,622,223.

Each of the aforementioned patents is therefore limited in that the formation testing tools described therein are only capable of acquiring formation data as long as the wireline tools are disposed in the wellbore and in physical contact with the formation zone of interest. Since "tripping the well" to use such formation testers consumes significant amounts of expensive rig time, it is typically done under circumstances where the formation data is absolutely needed or it is done when tripping of the drill string is done for a drill bit change or for other reasons.

The availability of reservoir formation data on a "real time" basis during well drilling activities is a valuable asset. Real time formation pressure obtained while drilling will allow a drilling engineer or driller to make decisions concerning changes in drilling mud weight and composition as well as penetration parameters at a much earlier time to thus promote safe drilling. The availability of real time reservoir formation data is also desirable to enable precision control of drill bit weight in relation to formation pressure changes and changes in permeability so that the drilling operation can be carried out at its maximum efficiency.

It is desirable therefore to provide an apparatus for well drilling that enables the acquisition of various formation data from a subsurface formation of interest while the drill string with its drill collars, drill bit and other drilling components are present within the well bore, thus eliminating or minimizing the need for tripping the well drilling equipment for the sole purpose of running formation testers into the wellbore for identification of these formation parameters.

More particularly, it is desirable to provide an apparatus that employs an extendable probe for contacting the wellbore wall during a measurement sequence in the midst of drilling the wellbore. The probe is typically positioned inside a portion of the drill string such as a tool collar during normal drilling operation. The section of such a collar that surrounds the probe is an important component of the tool, and its design has an impact on the quality of the measurement, the reliability of the tool and its ability to be used during drilling operations.

The section surrounding the probe, however, is typically not suitable for protecting the probe in its extended position against mechanical damage (cutting, debris, shocks to the wellbore wall, abrasion) and from erosion (from the fluids circulating in the annulus).

It is furthermore well known that the velocity of circulation fluids inside a wellbore has a direct effect on the thickness and integrity of the mud cake (the higher the velocity, the lower the sealing capabilities of the mud cake), which in turn will result in a local increase of the formation pressure near the wellbore wall (also called dynamic supercharging). This effect typically reduces the accuracy of the formation pressure as measured by a probe on a tool. In order to reduce the velocity effects when such a tool is operated and fluids are circulated in the wellbore, it is desirable to increase the flowing area in the annulus, thus reducing fluid velocity near the probe.

Many tools used for taking measurements (wireline and drill string conveyed) employ a pad, piston, or other device that is hydraulically or mechanically extended in association with, or opposite, a probe to make contact with the wellbore wall. Problems arise when there is a failure within the tool or the actuator extending and retracting these devices, leaving the tool deployed or set in the hole. Often times, the retrieval of the tool under such circumstances will permanently damage the hydraulic pistons leaving the tool inoperable or worse, lead to hydraulic leak possibly causing the tool to flood with mud. It is therefore further desirable to incorporate a system in such tools that permits the tools to be withdrawn when faced with such a failure without impacting the operation of the hydraulic and/or mechanical components.

SUMMARY OF THE INVENTION

In one aspect, a formation evaluation while drilling tool of a downhole tool positionable in a wellbore penetrating a subterranean formation is provided. The drilling tool includes a housing having at least one protuberance extending therefrom. The protuberance has at least one centralizing section and a protective section, with a probe positioned in the protective section, wherein the horizontal cross-sectional area of the housing along the protective section is less than the horizontal cross-sectional area of the housing along the at least one centralizing section.

In another aspect, a formation evaluation while drilling tool of a downhole tool positionable in a wellbore penetrating a subterranean formation is provided. The drilling tool includes a housing having at least one protuberance extending therefrom having at least one helical end portion and a linear portion. A probe is positioned in the linear portion of the at least one protuberance, such that the horizontal cross-sectional area of the housing along the at least one helical end portion is larger in the horizontal cross-sectional area of the housing along the linear portion whereby fluid velocity adjacent the linear portion is reduced.

In another aspect, a formation evaluation while drilling tool of a downhole tool positionable in a wellbore penetrating a subterranean formation is provided. The drilling tool includes a housing having at least one probe protuberance and at least one centralizing protuberance extending therefrom, wherein the at least one centralizing protuberance is positioned a distance from the at least one probe protuberance. A probe is positioned in the at least one probe protuberance such that a horizontal cross-sectional area of the housing along the at least one probe protuberance is less than the a horizontal cross-sectional area of the housing along the at least one centralizing protuberance.

In yet another aspect, a downhole formation evaluation while drilling tool positionable in a wellbore penetrating a subterranean formation is provided. The tool includes a housing having a probe extending therefrom for contacting a sidewall of the wellbore; and a backup piston extendable from the housing to contact the sidewall of the wellbore and apply a force thereto whereby the probe is driven into position against the sidewall of the wellbore, the backup piston selectively detachable from the housing upon receipt of a pre-determined shear load.

In accordance with a still further aspect, a method of evaluating a formation via a downhole tool positionable in a wellbore penetrating a subterranean formation is provided. The method includes disposing the downhole tool in the wellbore, the downhole tool having a probe extending therefrom; driving the probe into contact with the wellbore wall by selectively extending a backup piston from the downhole tool; and detaching the backup piston from the downhole tool when a predetermined shear force is applied thereto.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

FIG. P1 illustrates a convention drilling rig and drill string in which the present invention can be utilized to advantage.

DETAILED DESCRIPTION OF THE INVENTION

Figure 1:
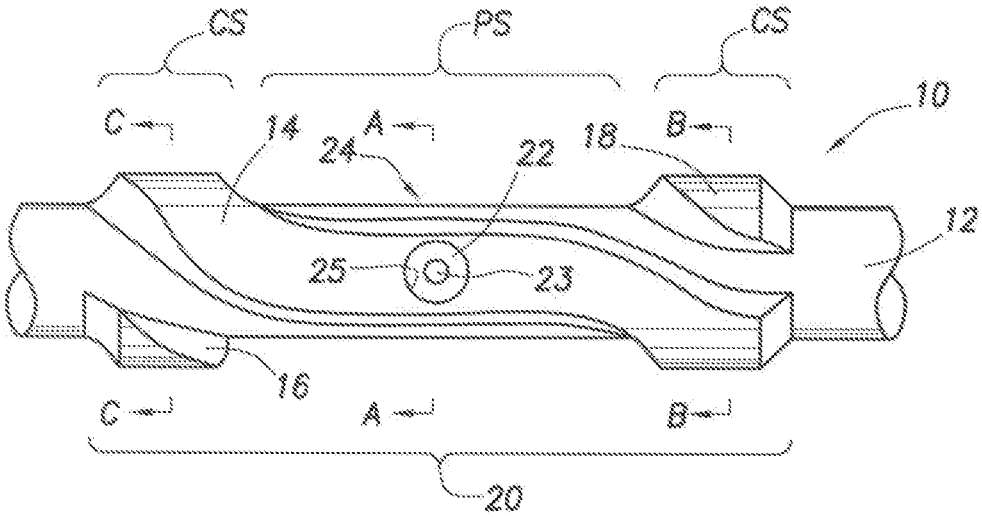
FIG. 1 is a side view of one embodiment of an apparatus for acquiring information from a subsurface formation in accordance with one aspect of the present invention.

FIG. P1 illustrates a convention drilling rig and drill string in which the present invention can be utilized to advantage. A land-based platform and derrick assembly 110 are positioned over wellbore W penetrating subsurface formation F. In the illustrated embodiment, wellbore W is formed by rotary drilling in a manner that is well known. Those of ordinary skill in the art given the benefit of this disclosure will appreciate, however, that the present invention also finds application in directional drilling applications as well as rotary drilling, and is not limited to land-based rigs.

Drill string 112 is suspended within wellbore W and includes drill bit 115 at its lower end. Drill string 112 is rotated by rotary table 116, energized by means not shown, which engages kelly 117 at the upper end of the drill string. Drill string 112 is suspended from hook 118, attached to a traveling block (also not shown), through kelly 117 and rotary swivel 119 which permits rotation of the drill string relative to the hook.

Drilling fluid or mud 126 is stored in pit 127 formed at the well site. Pump 129 delivers drilling fluid 126 to the interior of drill string 112 via a port in swivel 119, inducing the drilling fluid to flow downwardly through drill string 112 as indicated by directional arrow 109. The drilling fluid 126 exits drill string 112 via ports in drill bit 115, and then circulated upwardly through the annulus between the outside of the drill string and the wall of the wellbore, as indicated by direction arrows 132. In this manner, the drilling fluid lubricates drill bit 115 and carries formation cuttings up to the surface as it is returned to pit 127 for recirculation.

The drill string 112 further includes a bottom hole assembly, generally referred to as 100, near the drill bit 115 (in other works, within several drill collar lengths from the drill bit). The bottom hole assembly includes capabilities for measuring, processing, and storing information, as well as communicating with the surface. The assembly 100 further includes drill collar 130 for performing various other measurement functions, and surface/local communications subassembly 150.

Drill string 112 is further equipped in the embodiment of FIG. P1 with stabilizer collar 300. Such stabilizing collars are utilized to address the tendency of the drill string to "wobble" and become decentralized as it rotates within the wellbore, resulting in deviations in the direction of the wellbore from the intended path (for example, a straight vertical line). Such deviation can cause excessive lateral forces on the drill string sections as well as the drill bit, producing accelerated wear. This action can be overcome by providing a means for centralizing the drill bit and, to some extent, the drill string, within the wellbore. Examples of centralizing tools that are known in the art include pipe protectors and other tools, in addition to stabilizers. The present invention has application in each of such tools, as well as others, although it will now be described in general terms.

FIG. 1 illustrates a drill string apparatus 10 for acquiring information from a subsurface formation penetrated by a wellbore W. In a first aspect, the apparatus 10 includes a tubular body 12 adapted for connection within a drill string disposed in the wellbore W in a manner such as that shown in FIG. P1. The tubular body 12 is equipped with one or more protuberances 14, 16, 18 along an axial portion thereof defining an expanded axial portion 20. The term "protuberant" is used herein to include portions of the apparatus 10 that thrust outwardly from the tubular body 12, and includes "ribs," "blades," "lugs," and "wings" (all of which are used interchangeably) that tend to stabilize or centralize the tubular body by contact with the wellbore wall W.

A probe 22 is carried by the tubular body 12 at or near a first location 24 within the expanded axial portion 20 of the body 12 where the cross-sectional area of the expanded axial portion 20 is a minimum, or is at least reduced considering the surrounding structure. The probe 22 is moveable between retracted and extended positions in a manner that is well known in the art. A hydraulic or electrical actuator (not shown) is carried by the tubular body 12 for moving the probe 22 between its retracted and extended positions. The extended position permits the probe 22 to engage the wall of the wellbore W (see, e.g., FIG. 4) and acquire information from a subsurface formation of interest, while the retracted position (see, e.g., FIG. 11B) is for protecting the probe while drilling. An example of a hydraulic actuator that may be used to advantage is described in U.S. Pat. No. 6,230,557 commonly assigned to the assignee of the present application.

Figure 2:
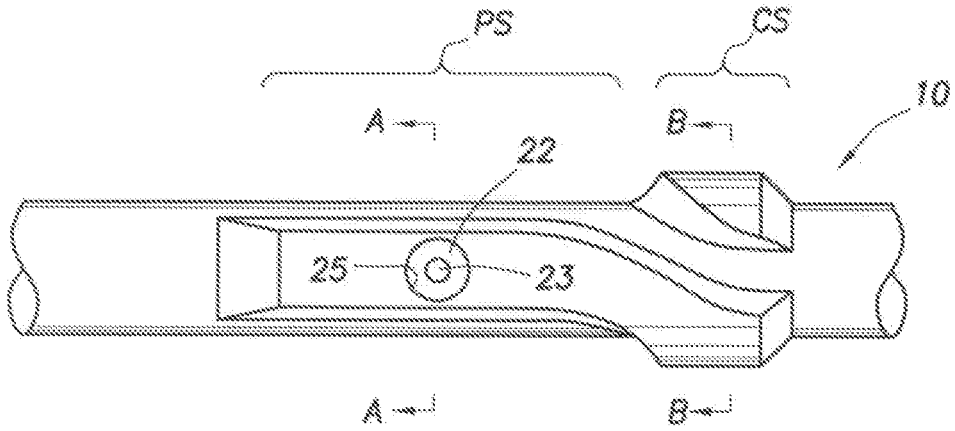
FIG. 2 is a side view of another embodiment of the apparatus for acquiring information from a subsurface formation.

With reference now to FIGS. 1 and 2, apparatus 10 is shown to incorporate two sections that may be referred to as a protective section PS and centralizing section(s) CS. Together, the two sections improve the reliability of the apparatus 10 as well as the quality of the measurement that it provides.

The primary purpose of the protective section PS is to protect the probe 22 against mechanical damage resulting from cuttings, debris, shocks to the wellbore wall W, and abrasion, as well as from erosion resulting from the fluids circulating in the wellbore annulus. It is well known that the velocity of fluids, such as drilling mud 126, circulating inside a wellbore has a direct effect on the thickness and integrity of the mud cake, i.e., the higher the velocity, the lower the sealing capabilities of the mud cake. This, in turn, will result in a local increase of the formation pressure near the wellbore wall W, known in the art as "dynamic supercharging." This effect typically reduces the accuracy of the formation pressure as measured by the probe 22 on the apparatus 10. In order to reduce these velocity effects when such a tool is operated and fluids are circulated in the wellbore, the cross-section of the apparatus 10 in the protective section PS is preferably kept to a minimum (see, e.g., FIG. 4) or reduced, resulting in a larger flowing area in the annulus, and thus reducing fluid velocity near the probe 22.

Figure 5:
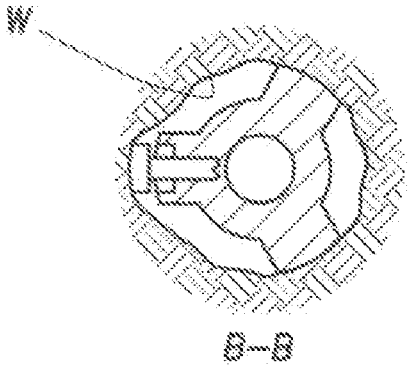
Figure 6:
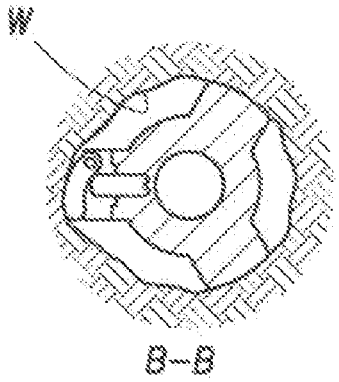

A typical operation of apparatus 10 imposes high contact forces on the probe 22. It is therefore possible, and generally advisable, to dispose one or more back-up supports such as a back-up piston (see FIG. 5) or a back-up support plate (see FIG. 6) inside one of the protuberances 14, 16, 18 of the centralizing section CS for movement between extended and retracted positions (described further below). Such devices may alternatively be disposed inside the protuberances within the protective section PS, although this is not presently preferred. The back-up support may be actuated hydraulically or mechanically in ways that are also well known in the art. An example of a suitable hydraulic actuator is described in U.S. patent application Ser. No. US 2003/0098156 A1 which is commonly assigned to the assignee of the present invention.

Figure 3:
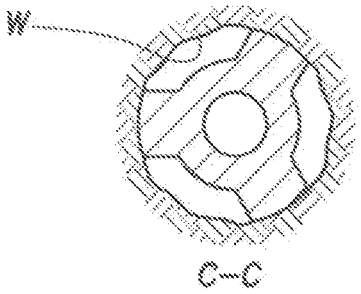
FIGS. 3-6 are simplified cross-sectional views of the apparatus according to the embodiments shown in FIGS. 1 and 2.

FIG. 1 shows an example of the apparatus 10 having two centralizing sections CS; FIG. 2 shows and example of the apparatus 10 with only one centralizing section CS. The primary purpose of the centralizing section(s) CS is to centralize the apparatus 10 inside the wellbore well W to ensure a better sealing of the probe 22 when it is moved to a deployed position. The profile of the centralizing section is similar to a conventional spiral-blade stabilizer in order to reduce the shocks on the apparatus 10 during rotary drilling, and also reduce torque and drag. An example of three-blade section(s) CS is given in FIG. 3, but four or more blades are also possible.

In various embodiments according to this aspect of the invention, the tubular body 12 of the apparatus 10 may be a drill collar, a stabilizer (rotating or non-rotating) equipped with a plurality of ribs/blades for stabilizing the drill string, or a centralizer equipped with a plurality of ribs/blades for centralizing the drill string.

The tubular body 12 is, in the particular embodiment shown in FIG. 1, equipped with a protuberance 14 defining a first rib that spans substantially the length of the expanded axial portion 20. The tubular body 12 is also equipped with protuberances 16, 18 defining second and third ribs, each having a length less than half the length of the first rib 14. The second and third ribs 16, 18 of this embodiment are disposed on opposing sides of the midpoint of the expanded axial portion 20. The first location 24 lies at the midpoint of the expanded axial portion 20.

Figure 7A:
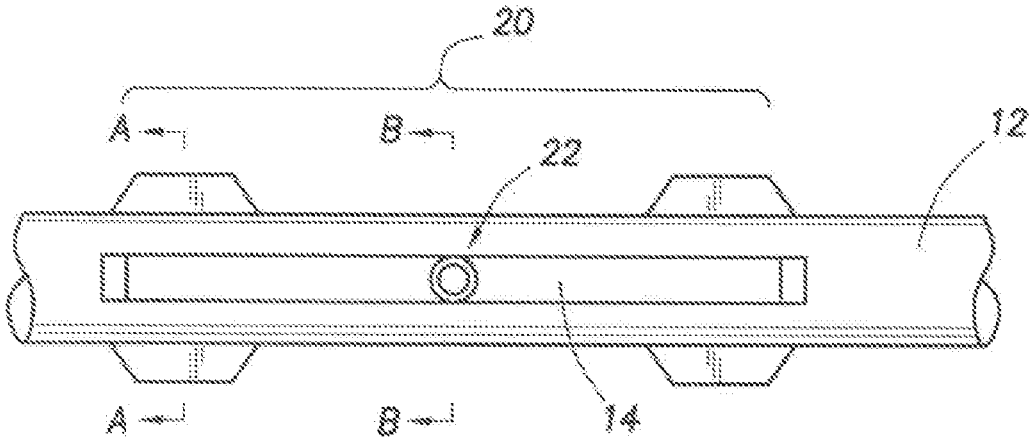
FIG. 7A is a side view of a third embodiment of the apparatus for acquiring information from a subsurface formation.
Figure 7B:
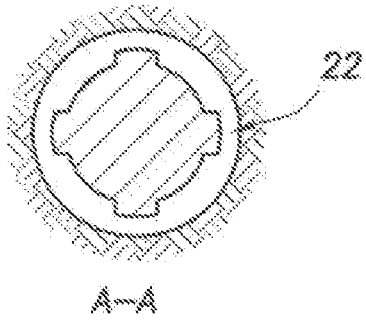
FIGS. 7B-7C are cross-sectional views of the apparatus according to the embodiment shown in FIG. 7A.
Figure 7C:
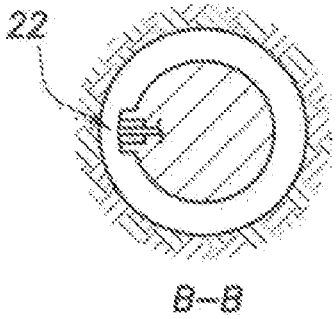
Figure 8:
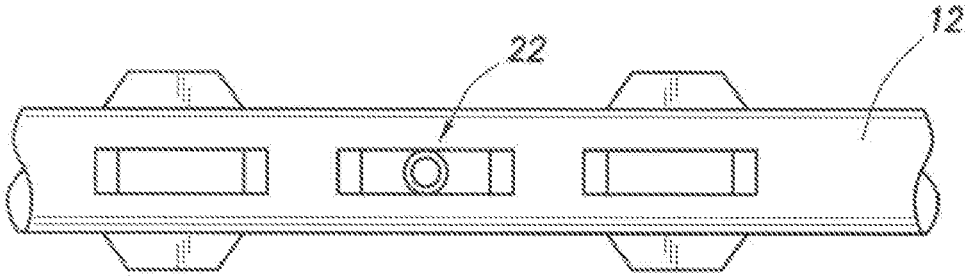
FIG. 8 is a side view of a fourth embodiment of the apparatus for acquiring information from a subsurface formation.
Figure 9:
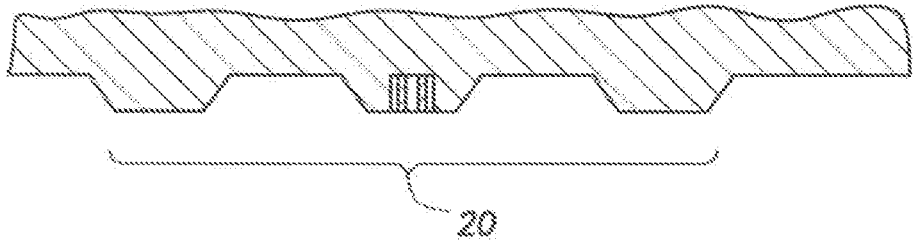
FIG. 9 is a partial sectional view of the apparatus according to the embodiment shown in FIG. 8.
Figure 10A:
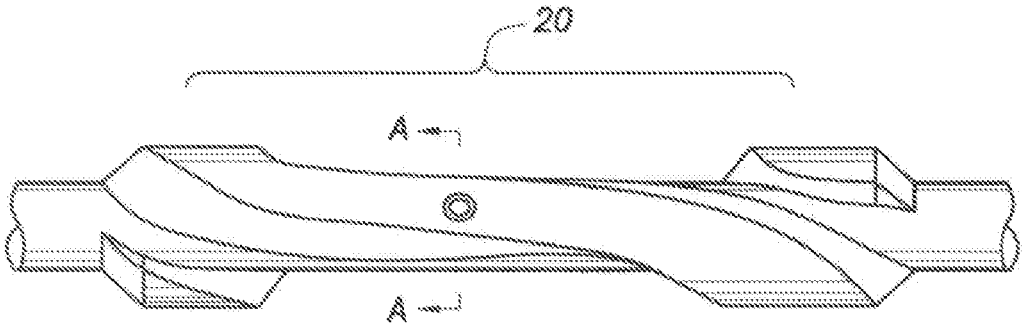
FIG. 10A is a side view of a fourth embodiment of the apparatus for acquiring information from a subsurface formation.
Figure 10B:
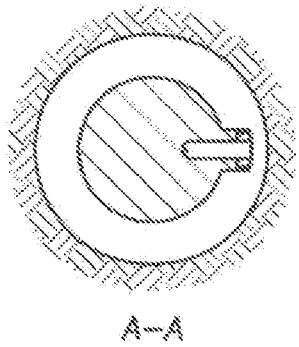
FIG. 10B is a cross-sectional view of the apparatus according to the embodiment shown in FIG. 10A.

The tubular body 12 may be further equipped with a fourth rib that spans substantially the length of the expanded axial portion radially opposite the first rib (see, e.g., FIGS. 7A-7B). Other configurations are depicted in FIGS. 7C, 8, 9, 10A and 10B.

In the embodiment of FIG. 1, the first rib 14 is helicoidal near its ends and axially linear intermediate its ends. In various embodiments, each of the ribs may be one of helicoidal, oblique, and axially linear (see FIG. 7A). Furthermore, one or more of the ribs may have a thickness that varies over its length (see FIG. 10A).

Figure 4:
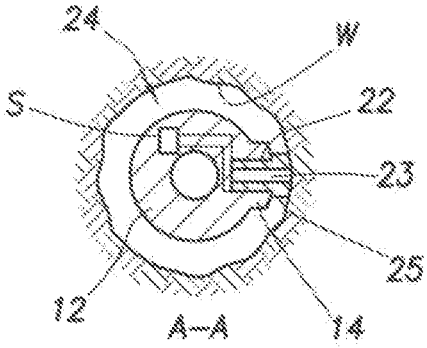

With reference now to FIG. 4, the probe 22 typically includes a conduit 23 disposed within an annular seal, or "packer," 25, and a sensor S in fluid communication with the conduit 23 for measuring a property of the formation. The sensor may, e.g., be a pressure sensor adapted for measuring the pore pressure of the formation once the probe is extended into engagement with the wellbore wall W.

Figure 11A:
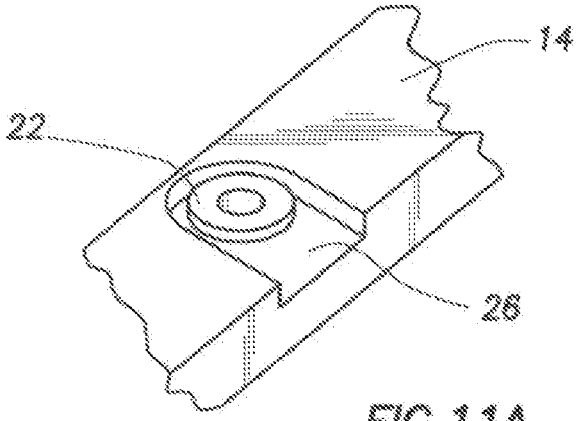
FIG. 11A is a perspective view of a stabilizer blade of an apparatus for acquiring information from a subsurface formation in accordance with another aspect of the present invention, the stabilizer blade having a debris channel.
Figure 11B:
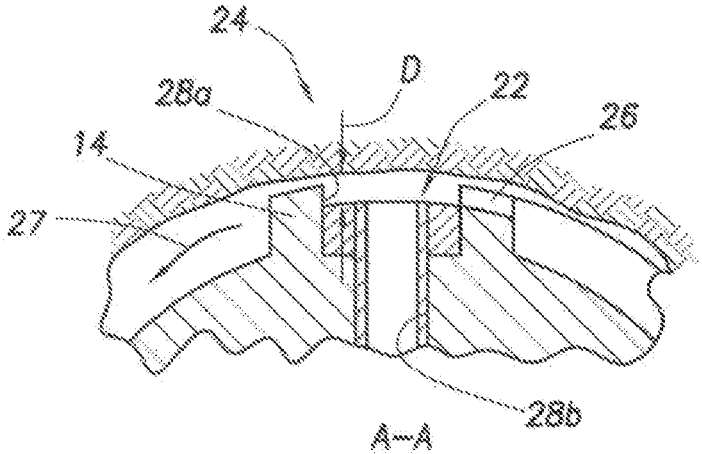
FIG. 11B is a sectional, elevational view of the stabilizer blade shown in FIG. 11A.
Figure 11C:
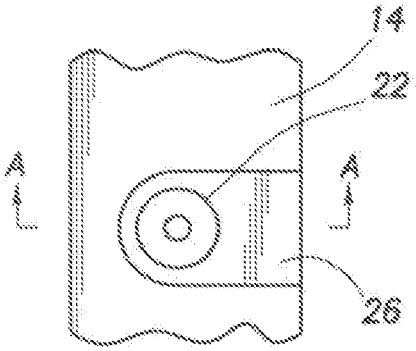
FIG. 11C is a plan view of a portion of the stabilizer blade shown in FIG. 11A.
Figure 12:
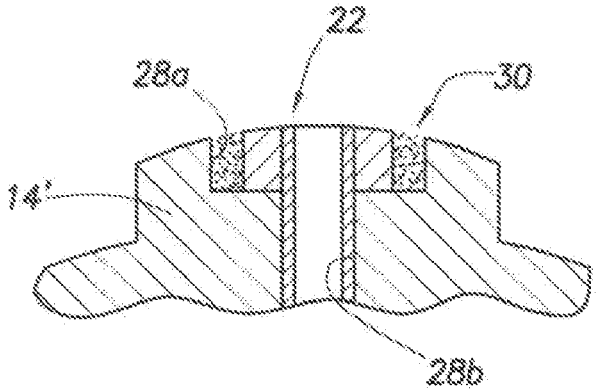
FIG. 12 is a sectional, elevational view of a stabilizer blade similar to that shown in FIG. 11B, but without a debris channel or probe recess space.

According to a particular embodiment of the apparatus represented by FIGS. 11A-11C, the first location 24 lies on a rib 14 within the expanded axial portion 20, and the probe 22 is at least partially carried within a bore 28*a*/28*b* within a channel 26 formed in the rib at or near the first location 24 (see also FIG. 1). The rib 14 extends radially beyond the retracted probe 22 such that the probe is recessed by a distance D within the rib when the probe is retracted. The channel 26 has a width sized for closely bounding a portion of the probe 22 (i.e., packer 25) and the channel extends transversely (generally azimuthally) from the probe through a side of the rib 14 opposite the direction of drill string rotation (assuming rotary drilling; see arrow 27), as shown particularly in FIGS. 11A and 11C. In this manner, wellbore debris is free to flow along the channel 26 away from the probe 22 during drilling. This may be contrasted with the rib 14' shown in FIG. 12, which has no debris channel or probe recess depth D, and consequently exhibits a buildup of debris 30 that can impede the movement of the probe 22 within upper bore region 28*a*.

Figure 14:
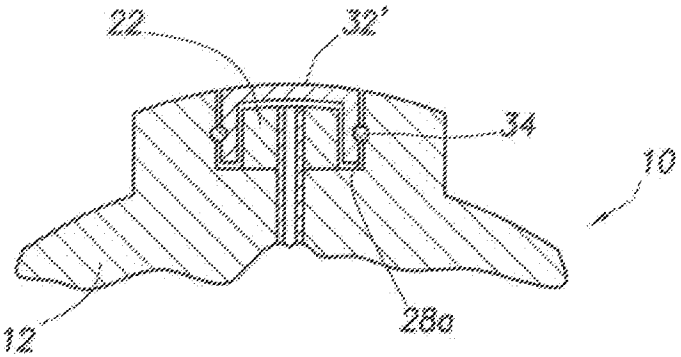
FIGS. 14-15 are sectional, elevational views of alternative versions of the protective cover shown in FIGS. 13A-13B.
Figure 15:
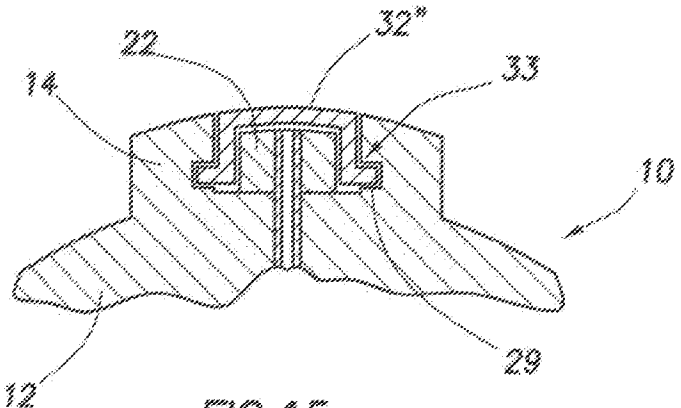
Figure 13A:
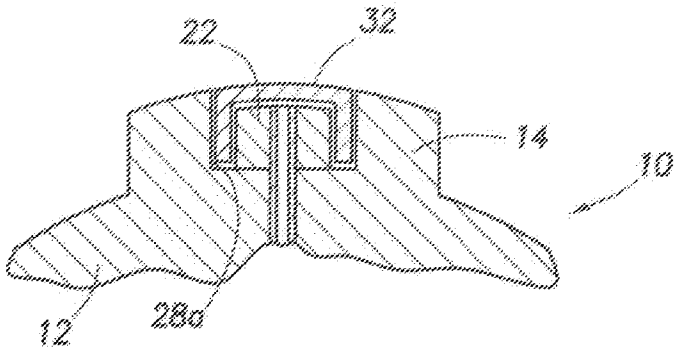
FIGS. 13A-13B are sequential sectional, elevational views of a probe within a stabilizer blade of an apparatus for acquiring information from a subsurface formation in accordance with a third aspect of the present invention, the probe releasing a protective cover as the probe moves from a retracted to an extended position.
Figure 13B:
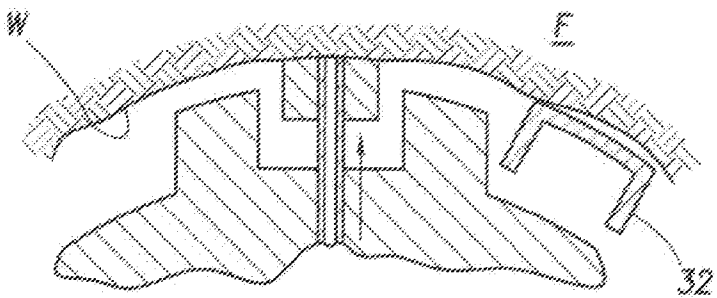

With reference now to FIGS. 13-15, the inventive apparatus may further include a cover 32 releasably-secured about the probe 22 within upper bore region 28*a* for protecting the probe while drilling prior to the probe being first moved from bore region 28*a* to its extended position. In this manner, the movement of the probe by the probe actuator (not shown) to the probe's extended position (see FIG. 13B) releases the cover 32 from the probe and positions the probe in engagement with the wall W of the wellbore for acquiring information from the formation F. The cover 32 is made of a drillable material.

In a typical embodiment according to this aspect of the invention, the probe 22 is substantially cylindrical and is carried for movement within the bore 28*a*/28*b* in a protuberance (e.g., rib 14) formed along a portion of the tubular body 12 of the apparatus 10. The cover 32 has a continuous cylindrical side wall sized to closely fit in an annulus formed between the probe 22 and the wall of the bore region 28*a* when the probe is retracted (see FIG. 13A).

In another embodiment, shown in FIG. 14, a first annular groove is formed in the wall of the upper bore region 28*a* in the protuberance, and a second annular groove is formed in the side wall of the cover 32'. The first and second annular grooves align to form a toroidal space when the cover is secured about the probe. A shearable ring 34 is disposed in the toroidal space for releasably securing the cover 32' to the bore region 28*a*.

Alternatively, with reference to FIG. 15, an annular groove 29 is formed in the wall of the bore region 28*a* in the rib 14, and the side wall of the cover 32" is equipped with a shearable annular flange 33 at an end thereof adapted to fit the annular groove 29.

Still further, with reference now to FIGS. 16-19, the inventive apparatus 10 may include a backup support 40 carried by the tubular body 12 azimuthally (radially) opposite the probe 22 (compare also FIG. 4 with FIGS. 5-6) and movable between retracted and extended positions. The backup support 40 is designed to shear at a preselected location upon encountering a predetermined shear load. A backup support actuator is also carried by the tubular body for moving the backup support between its retracted and extended positions, as mentioned above. The extended position is for assisting the engagement of the probe with the wall of the wellbore by increasing the well bore wall contact surface with the back-up support, and thus the reactive force delivered through the apparatus 10 to the probe 22 when the backup support is extended. The retracted position serves to protect the backup support while drilling.

In the embodiment shown in FIGS. 16-17, the backup support 40 includes a piston body 42 carried within a bore 41 in the tubular body 12 for movement between extended and retracted positions. The back-up support further includes a piston head 44 carried at least partially within a bore in the piston body 42 for movement between the extended and retracted positions. The piston head 44 is designed to shear upon encountering the predetermined shear load.

The shear design of the piston head 44 may be accomplished by material selection. For example, the piston head may includes a material having a relatively low shear strength. Suitable materials include aluminum alloys and oriented strand composites. The shear may be achieved by erosion and/or by shear failure.

The shear (i.e., sacrificial) design of the piston head 44 may also be accomplished—either independently or in combination with material selection—by mechanical tuning. For example, the piston head 44 may include a central base 46 formed of metal and an outer composite jacket 48 secured about the central base. In this embodiment, the central base 46 may have grooves formed therein for mechanical engagement by the composite jacket. Such grooves may additionally serve as preferential shear failure sites, since they will reduce the load-bearing cross-sectional area of the piston head 44. The central base should also be made from a drillable material as large pieces can break off and wind up in the wellbore when the piston head fails.

Figure 16B:
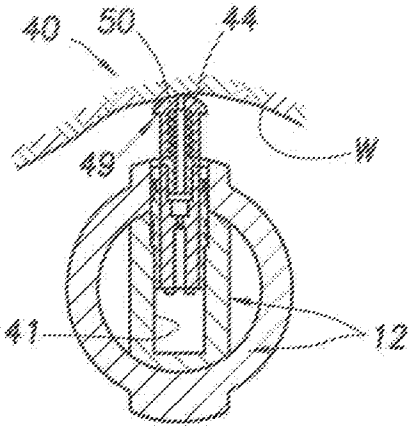
FIGS. 16A-16B are axial and radial cross-sectional views of a portion of an apparatus for acquiring information from a subsurface formation in accordance with a fourth aspect of the present invention, the apparatus having a back-up support moved to an extended position.

More particularly, the composite jacket 48 has an enlarged outer diameter at a distal end, forming a mushroom-shaped head 50 having a shoulder 49 (see FIG. 16B). The shoulder 49 has radial grooves formed therein providing channels for debris to flow clear of the shoulder, thereby reducing the likelihood of debris becoming trapped between the head 50 and the tubular body 12 when the piston head is moved to its retracted position.

Those skilled in the art will appreciate that the piston body 42 remains recessed in the tubular body 12 of the apparatus 10 even when the back-up support 40 is fully extended. This leaves only the piston head 44 extending from the tool. The body 42 of the piston contains all sealing surfaces between the "clean" hydraulics within the apparatus 10 and the mud in the wellbore. In the event of a failure whereby apparatus 10 becomes stuck in the wellbore W, the apparatus could be pulled free, causing the piston head 44 to undergo shear failure (see FIGS. 17A-17B) without damaging the main body 42 of the piston or unsealing the hydraulics. Since the material of the piston head is drillable, even large pieces would not interfere with the drilling process.

Figure 17B:
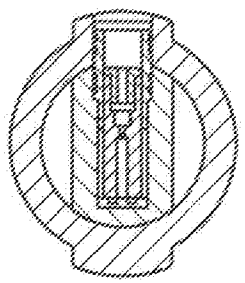
FIGS. 17A-17B are axial and radial cross-sectional views of the back-up support moved to a retracted position after a portion of the back-up support has been sheared away.
Figure 16A:
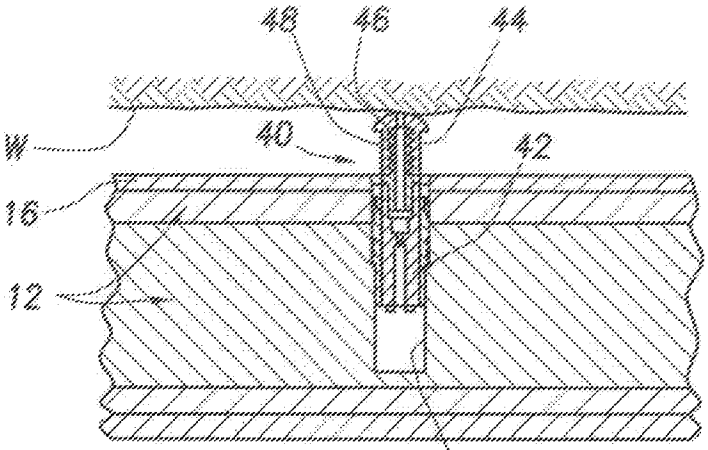
Figure 17A:
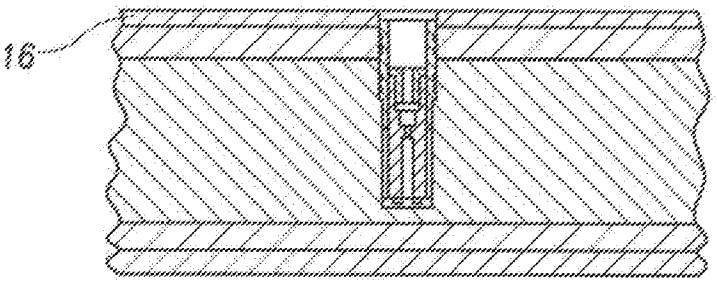

FIGS. 16A-16B show both axial and radial cross-sections through the back-up support 40, with the support being fully extended. Again, the piston body 42 remains completely recessed within the outer diameter of the tubular body 12, even in the fully extended position. FIGS. 17A-17B show the piston body 42 in its fully retracted state, sans a portion of the piston head 44 which has been sheared away.

When the apparatus 10 is set and retrieval is necessary, there are several failure modes that the piston head 42 can take depending on the amount it is extended and the rugosity of the wellbore wall W. If the piston head is only extended partially, as in a hole that is only slightly larger than the diameter of the apparatus 10, the piston material may only erode from abrasion against the wellbore wall W as the tool is removed. In a larger diameter hole, or a very rugose hole, the piston head 44 would likely shear into large pieces upon retrieval as there would be a large moment around the base of the piston and a high likelihood that the piston head could get caught on a ledge or similar obstruction in the wellbore.

As mentioned above, the material(s) of the piston head 44 can be "tuned" for strength, elasticity, abrasion, and erosion resistance. In its simplest form the piston head could be made from a low strength metal such as an aluminum alloy. Another option is an oriented strand composite. This option could be used to customize both the compressive and shear properties of the piston head almost independently of one another. With this ability, the piston head could be made extremely strong in compression for normal setting purposes and relatively weak in shear to enable it to fail at a reasonable pull force for a wireline application or the drill pipe.

Figure 18:
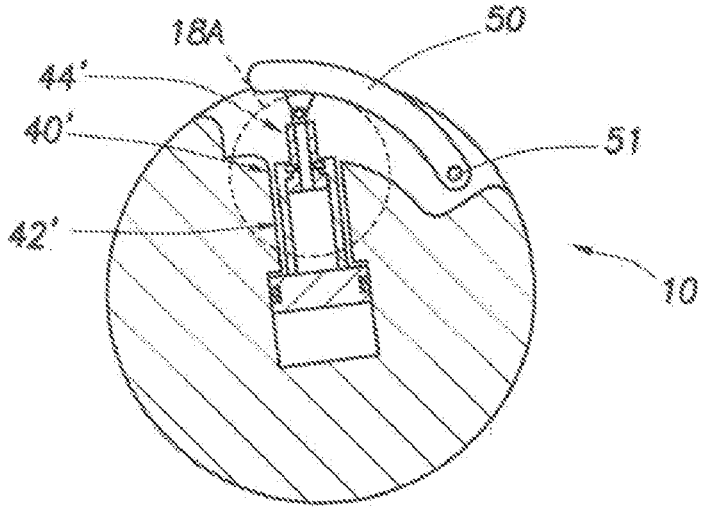
FIG. 18 is a cross-sectional view of a drill string apparatus having an alternative back-up support to that shown in FIGS. 16A-16B.
Figure 18A:
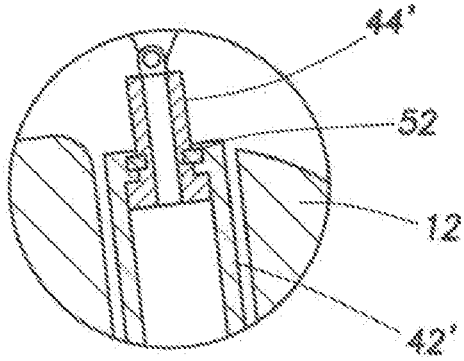
FIG. 18A is an enlarged, detailed view of a portion of the back-up support shown in FIG. 18.
Figure 19:
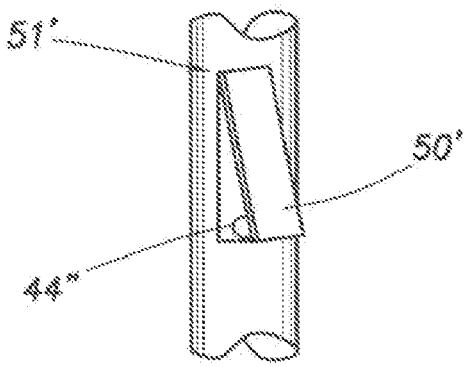
FIG. 19 is a perspective view of a portion of a drill string having an alternative back-up support to that shown in FIG. 18.

Turning now to FIGS. 18-19, the piston head 44' can be made to collapse within the piston body 42' of the back-up support 40' rather than shearing or abrading or eroding the back-up support. This is accomplished with the use of shear pins 52 to connect the piston head 44' and piston body 42', and a plate or "shoe" 50 hinged at pin 51 to supply an axial load to the shear pins 52 when the shoe 50 is loaded by an amount (e.g., via vigorous engagement with wellbore wall W) that exceeds the predetermined shear threshold.

The hinged shoe 50' can be oriented axially (see FIG. 19) rather than radially (as in FIG. 18) to apply the desired load to shear pins 52, depending on the preferred method of retraction. If rotation of the apparatus 10 is the preferred method, the hinged shoe 50 should be oriented as shown in FIG. 18. If pulling axially on the drill string would be the preferred method of extraction of the apparatus 10, the hinged shoe 50' should be oriented as shown in FIG. 19. The advantage of this method versus the previously described method is that there are no large pieces left in the hole, although it sacrifices simplicity.

It will be understood from the foregoing description that various modifications and changes may be made in the preferred and alternative embodiments of the present invention without departing from its true spirit.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A formation evaluation while drilling tool of a downhole tool positionable in a wellbore penetrating a subterranean formation, comprising:

a housing;

at least one protuberance extending from the housing, the at least one protuberance having at least one centralizing section and a protective section; and a probe positioned in the protective section of the at least one protuberance;

wherein the horizontal cross-sectional area of the housing along the protective section is less than the horizontal cross-sectional area of the housing along the at least one centralizing section.

2. The formation evaluation while drilling tool of claim 1, wherein the at least one centralizing section is helical.

3. The formation evaluation while drilling tool of claim 1, wherein the protective section is linear.

4. The formation evaluation while drilling tool of claim 1, wherein the at least one protuberance has a thickness that varies over its length.

5. The formation evaluation while drilling tool of claim 1, wherein the probe is recessed within the protective section and is extendable therefrom.

6. The formation evaluation while drilling tool of claim 1, wherein the protuberances extend axially along the outer surface of the housing.

7. The formation evaluation while drilling tool of claim 1, wherein a plurality of protuberances are positioned radially about the housing.

8. The formation evaluation while drilling tool of claim 1, further comprising a backup piston extendable from the housing to contact the sidewall of the wellbore and apply a force thereto whereby the probe is driven into position against the sidewall of the wellbore.

9. The formation evaluation while drilling tool of claim 8, wherein the backup piston is selectively detachable from the housing upon receipt of a pre-determined shear load.

10. The formation evaluation while drilling tool of claim 1, further comprising a probe cover releaseably secured about the probe and removable therefrom upon extension of the probe.

11. A formation evaluation while drilling tool of a downhole tool positionable in a wellbore penetrating a subterranean formation, comprising:

a housing;

at least one protuberance extending from the housing, the at least one protuberance having at least one helical end portion and a linear portion; and a probe positioned in the linear portion of the at least one protuberance;

wherein the horizontal cross-sectional area of the housing along the at least one helical end portion is larger in the horizontal cross-sectional area of the housing along the linear portion whereby fluid velocity adjacent the linear portion is reduced.

12. The formation evaluation while drilling tool of claim 11, wherein the at least one protuberance has a thickness that varies over its length.

13. The formation evaluation while drilling tool of claim 11, wherein the at least one protuberance has a gap between the linear portion and the at least one helical end.

14. The formation evaluation while drilling tool of claim 11, wherein the probe is recessed within the linear portion and is extendable therefrom.

15. The formation evaluation while drilling tool of claim 11, wherein the protuberances extend axially along the outer surface of the housing.

16. The formation evaluation while drilling tool of claim 11, wherein a plurality of protuberances are positioned radially about the housing.

17. The formation evaluation while drilling tool of claim 11, further comprising a backup piston extendable from the housing to contact the sidewall of the wellbore and apply a force thereto whereby the probe is driven into position against the sidewall of the wellbore.

18. The formation evaluation while drilling tool of claim 17, wherein the backup piston is selectively detachable from the housing upon receipt of a pre-determined shear load.

19. The formation evaluation while drilling tool of claim 11, further comprising a probe cover releaseably secured about the probe and removable therefrom upon extension of the probe.

20. A formation evaluation while drilling tool of a downhole tool positionable in a wellbore penetrating a subterranean formation, comprising:

a housing;

at least one probe protuberance extending from the housing;

at least one centralizing protuberance extending from the housing, the at least one centralizing protuberance positioned a distance from the at least one probe protuberance; and a probe positioned in the at least one probe protuberance;

wherein a horizontal cross-sectional area of the housing along the at least one probe protuberance is less than the a horizontal cross-sectional area of the housing along the at least one centralizing protuberance.

21. The formation evaluation while drilling tool of claim 20, wherein the probe is an extendable probe.

22. The formation evaluation while drilling tool of claim 20, wherein at least one of the at least one centralizing protuberances and at least one of the at least one probe protuberances extend axially along the outer surface of the housing.

23. The formation evaluation while drilling tool of claim 22, wherein a centralizing protuberance is positioned above the probe protuberance, and a centralizing protuberance is positioned below the probe protuberance.

24. The formation evaluation while drilling tool of claim 23, wherein the at least one centralizing protuberances are positioned radially about the housing.

25. The formation evaluation while drilling tool of claim 20, further comprising a backup piston extendable from the housing to contact the sidewall of the wellbore and apply a force thereto whereby the probe is driven into position against the sidewall of the wellbore.

26. The formation evaluation while drilling tool of claim 25, wherein the backup piston is selectively detachable from the housing upon receipt of a pre-determined shear load.

27. The formation evaluation while drilling tool of claim 20, further comprising a probe cover releaseably secured about the probe and removable therefrom upon extension of the probe.

28. A downhole formation evaluation while drilling tool positionable in a wellbore penetrating a subterranean formation, comprising;

a housing having a probe extending therefrom for contacting a sidewall of the wellbore:

a backup piston extendable from the housing to contact the sidewall of the wellbore and apply a force thereto whereby the probe is driven into position against the sidewall of the wellbore, the backup piston selectively detachable from the housing upon receipt of a predetermined shear load.

29. A method of evaluating a formation via a downhole tool positionable in a wellbore penetrating a subterranean formation, comprising:

disposing the downhole tool in the wellbore, the downhole tool having a probe extending therefrom;

driving the probe into contact with the wellbore wall by selectively extending a backup piston from the downhole tool;

detaching the backup piston from the downhole tool when a predetermined shear force is applied thereto.

* * * * *